US005526967A

United States Patent [19]

Kim

[11] Patent Number: 5,526,967

[45] Date of Patent: Jun. 18, 1996

[54] METHODS AND DEVICES FOR SHAPING GARMENT COLLARS AND CONVEYING DISCOUNTCOUPONS AND OTHER ADVERTISING MEDIA

[76] Inventor: Chung B. Kim, 121 Hillcrest Ave., Pittsburg, Calif. 94565

[21] Appl. No.: 333,884

[22] Filed: Nov. 3, 1994

Related U.S. Application Data

[63] Continuation of Ser. No. 58,946, May 6, 1993.

[51] Int. Cl.[6] ..... D06C 15/00; B65D 85/18

[52] U.S. Cl. ..... 223/81; 223/83; 223/84; 206/297

[58] Field of Search ..... 223/81, 83, 84, 223/52.1; 206/292, 297, 296, 295

[56] References Cited

U.S. PATENT DOCUMENTS

| | | | |
|---|---|---|---|
| 2,149,192 | 2/1939 | Steele | 223/83 |
| 2,158,379 | 5/1939 | Peyton | 223/83 |
| 2,401,789 | 6/1946 | McFall et al. | 223/83 |
| 2,503,885 | 11/1950 | Lighter | 223/83 |
| 2,518,300 | 8/1950 | Fine, Sr. | 223/83 |
| 2,559,406 | 7/1951 | Darling | 223/83 |
| 2,568,871 | 9/1951 | Steele | 223/83 |
| 2,712,889 | 7/1955 | Lighter | 223/83 |
| 2,846,127 | 8/1958 | Tomarin | 223/83 |
| 3,107,830 | 10/1963 | Teague | 223/83 |
| 3,281,026 | 10/1966 | Calder | 223/83 |

*Primary Examiner*—C. D. Crowder
*Assistant Examiner*—Bibhu Mohanty
*Attorney, Agent, or Firm*—Schapp and Hatch

[57] ABSTRACT

Methods and devices for shaping garment collars and conveying discount coupons and other advertising media are disclosed in which the collar shaping devices consist of a single piece of paperboard or other resiliently flexible material, the paperboard being divided by elongated cuts into a tongue projecting from a spine and fingers also projecting outward from the spine and lying on both sides of the tongue.

3 Claims, 5 Drawing Sheets

METHODS AND DEVICES FOR SHAPING GARMENT COLLARS AND CONVEYING DISCOUNTCOUPONS AND OTHER ADVERTISING MEDIA

This is a continuation of application Ser. No. 08/058,946, filed on May 6, 1993.

BACKGROUND OF THE INVENTION

1. Field of the Invention

My present invention relates to the laundering and dry cleaning of garments, and more particularly to methods and devices for maintaining the anterior portions of the collars of shirts, blouses and the like in optimum configuration, closely resembling the configuration assumed when the same are worn, from the time of laundering or dry cleaning to the time of donning, such devices being sometimes hereinafter called "collar shapers" or "collar formers".

2. Description of the Prior Art

Many different types of collar shapers or collar formers, as hereinabove defined, are known in the prior art.

By way of example, a commercially available collar shaper 10 of the prior art is shown in FIG. 1 hereof. Prior art collar shaper 10 consists of a single piece of paperboard die cut to the configuration shown in FIG. 10. The paperboard of the collar shaper of FIG. 10 is provided on its intended outer face with a white or blue-white coating. As seen in FIG. 1, collar shaper 10 comprises two projections or fingers 12, 14 and a central slot 16. As also seen in FIG. 1, prior art collar shaper 10 is installed by passing its fingers 12, 14 under the corresponding wings 18, 20 of the collar of the garment to which it is to be applied. The installation of collar shaper 10 is then completed by manually drawing the mutually confronting portions of the collar fully into slot 16. The prior art collar shaper of FIG. 1 suffers from the disadvantage that fully manually drawing the mutually confronting portions of the collar into slot 16 is a time-consuming operation, requiring the full attention and dexterous two-handed manipulation of the installer. This disadvantage is particularly crucial when, as in high-volume laundries, a large number of shirts or blouses must be processed every hour. Another disadvantage of the prior art collar shaper 10 of FIG. 1 lies in the fact that it does not maintain the collar in the abovesaid optimum configuration, but rather distorts the collar. That is, as shown in FIG. 1, prior art collar shaper 10 forces the mutually confronting portions of collar ends 18, 20 together along a common line 22. This is in contrast with the optimum configuration, i.e., the configuration normally assumed during wearing, and, since the collar remains thus distorted from the time of laundering or dry cleaning to the time of donning, it will be obvious to those having ordinary skill in the art that the collars of certain shirts or blouses will have a tendency to remain in this distorted configuration after the garment is donned, particularly if the garment collar has been forced into this distorted shape after several launderings or dry cleanings.

A yet further disadvantage of the prior art collar shaper of FIG. 10 is that, since it lacks any means for maintaining it in position under the garment collar other than the frictional engagement of the collar within slot 16, and since slot 16 must be sufficiently wide so that the collar can be easily manually inserted thereinto, it (the prior art collar shaper of FIG. 10) is very easily dislodged from its operative position. In fact, actual specimens of this prior art device, after being carefully installed in certain shirts, can be dislodged merely by holding the shirt upright and briskly shaking it four or five times. As is well known to those having ordinary skill in the art, shirts are commonly subjected to much more vigorous shaking during transport by truck from the laundering plant to the retail dry cleaning outlet where the garment is to be returned to the customer. Thus, it will be evident to those having ordinary skill in the art that prior art collar shaper 10 is incapable of supporting additional weight, e.g., a plurality of discount coupons or advertising flyers.

Another prior art collar shaper 30 is shown in FIG. 2. The body 32 of prior art collar shaper 30 is configured as shown in FIG. 2. A highly malleable metal tongue 34 is affixed to body 32 of prior art collar shaper 30 by means of two punchings 36, 38 which are driven into body 32. Body 32 is cut from C1S (coated one-side) paperboard similar to the paperboard from which prior art collar shaper 10 of FIG. 1 is cut.

Prior art collar shaper 30 of FIG. 2 suffers from the disadvantage that the provision of highly malleable metal member 34 and its affixation to body 32 considerably increases the cost of production thereof as compared with the cost of production of devices which are die stamped or otherwise formed from paperboard and do not consist of an additional part or parts.

Yet further, prior art collar shaper 30 suffers from the disadvantage that the locking effect provided by highly malleable metal member 34 is by no means as strong as might be expected. That is to say, the malleability of the tongue 34 of an actual commercial specimen of prior art collar shaper 30 is sufficiently great so that very little tractive force is required to withdraw it from a garment collar. Further, the raised portion 36 is easily withdrawn from body 32, thus making it even easier to withdraw prior art collar shaper 30 from an associated garment collar.

A yet further disadvantage of prior art collar shaper 30 is the concern of the customer, if not the actual fact, that metal tongue 34 may cut or discolor the neck of, e.g., a delicate silk blouse.

A prior art collar shaper 40 is shown in FIG. 3, inserted under the mutually confronting portions 42, 44 of a garment collar. Prior art garment shaper 40 is comprised of a body 46 of paperboard similar to the paperboard from which prior art collar shapers 10, 30 are fabricated. As seen in FIG. 3, body 46 of prior art collar shaper 40 is substantially rectangular, except for the slot or inlet 47 in its upper edge. As is also seen in FIG. 3, body 46 of prior art collar shaper 40 is provided with two areas 48, 50 of adhesive, whereby the two upper portions of body 46 can be adhered to the inner faces of collar ends 42, 44, after being passed under collar ends 42, 44.

Prior art collar shaper 40 suffers from the disadvantage that adhesive layers 48, 50 can prematurely adhere to the inner faces of collar ends 42, 44, thus interfering with the passing of collar shaper 40 under the ends 42, 44 of the collar.

Prior art collar shaper 40 also suffers from the disadvantage that the tackiness or "tack" of adhesive layers 48, 50 must be maintained over a considerable storage or shelf life. The expedients for so doing, such as the provision of overlying protective sheets, can greatly add to the cost of what must necessarily be an inexpensive device, given the economics of the market therefor. The alternative of mutually adhering adjacent ones of packaged specimens of prior art collar shaper 40, in the manner of the now well known "POST-IT NOTES" involves extensive packaging steps, which also tend to raise the price of a device which, given the nature of the market, must sell at a very low price.

Yet further, the provision of adhesive layers 48, 50, in itself, involves relatively costly production steps, and thus tends to raise the production cost of an item which, by the nature of its market, must be extremely cheap.

Other prior art collar shapers are also provided with layers or patches of adhesive material. All of these prior art devices, however, confront the problem that if the adhesive is too tacky it is difficult to insert the device into the collar, and thus an amount of adhesive coating is generally selected which is insufficient to strongly maintain these collar shapers against withdrawal or dislodgement.

It is to be understood that the term "prior art" as used herein or in any statement made by or on behalf of applicant means only that any document or thing referred to as prior art bears, directly or inferentially, a date which is earlier than the effective filing date hereof.

SUMMARY OF THE INVENTION

Accordingly, it is an object of my present invention to provide devices for shaping garment collars which are inexpensive to fabricate and are easily and rapidly installed in garments.

Another object of my present invention is to provide devices for shaping garment collars which achieve the above object, and each of which devices consist solely of a single piece of resiliently flexible sheet material.

Yet another object of my present invention is to provide devices for shaping garment collars which achieve the second above-stated object, and the resiliently flexible sheet material of which is heavy paper of the kind sometimes referred to as paperboard.

Another object of my present invention is to provide devices for shaping garment collars which achieve the second above-stated object, and the resilient sheet material of which is one of the synthetic materials sometimes referred to as "plastics".

An additional object of my present invention is to provide devices for shaping garment collars which achieve one or more of the abovestated objects and which comprise attaching means for attaching each such device to the garment in which it is installed and thus maintaining it in the same relationship to the garment as exists when it is installed.

Another object of my present invention is to provide devices for shaping garment collars which achieve at least the previously-stated object, and wherein the attaching means of each such device lakes the form of clasping means adapted for clasping a part or parts of the garment in which it is installed.

Yet another object of my present invention is to provide devices for shaping garment collars which achieve at least the immediately previously-stated object, and in each of which the clasping means is integral with the remainder of the device.

A further object of my present invention is to provide devices for shaping garment collars which achieve at least the immediately previously-stated object, and the clasping means of each such device is operable by one finger.

Another object of my present invention is to provide devices for shaping garment collars which achieve one or more of the above-staked objects, and each of which devices, when installed in a garment, is capable of supporting a substantial plurality of sheets of paper, such as discount coupons or advertising flyers, without becoming dislodged or substantially displaced with respect to said garment when said garment is subjected to truck transport or other formal handling.

Another object of my present invention is to provide a collar shaper which can easily be installed in both box-folded shirts and hanger-mounted shirts.

Other objects of my present invention will in part be obvious and will in part appear hereinafter.

My present invention, accordingly, comprises the several steps and the relation of one or more of such steps with respect to each of the others, and the apparatus embodying features of construction, combinations of elements and arrangements of parts which are adapted to affect such steps, all as exemplified in the following disclosure, and the scope of my present invention will be indicated in the claims appended hereto.

In accordance with a principal feature of my present invention a device for shaping garment collars is comprised of a body member and a tongue member hingedly joined to said body member.

In accordance with another principal feature of my present invention the hinge means joining said tongue member to said body member is a "live hinge", i.e., said tongue member, said body member, and said hinge means are fabricated from the same piece of paperboard or other sheet material.

In accordance with yet another principal feature of my present invention said body member is comprised of a spine member extending from end to end thereof along one edge thereof and a pair of finger members projecting outwardly from said spine member.

In accordance with another principal feature of my present invention said hinge means is located at the inner side of said spine member and lies between said inner ends of said finger members, which inner ends of said finger members are integrally joined to said spine member.

In accordance with yet another principal feature of my present invention said tongue member extends upwardly from said hinge means and said spine member and, at the time of fabrication of said device, lies between said finger members.

In accordance with yet another principal feature of my present invention said tongue member is provided at its outer end with a pair of oppositely directed ear members, each of said ear members, at the time of fabrication of said device, overlying the outer end of one of said finger members.

In accordance with another principal feature of my present invention each of said finger members is provided on its inner edge with an outwardly projecting protrusion or boss.

In accordance with an additional principal feature of my present invention a plurality of cuts extends in a straight line across said tongue, and the remaining web portions existing between said cuts define a plurality of "live hinges" whereby the inner portion of said tongue member is hingedly joined to the outer portion of said tongue member, said hinges sometimes hereinafter called the "medial hinges".

In accordance with yet another principal feature of my present invention one or more paper slips may be affixed to said spine member before installing said device in a garment, and each one or more of said paper slips may be one or more discount coupons or advertising flyers, whereby said discount coupons or advertising flyers, or combination thereof, may be affixed to a shirt or blouse in such position that said discount coupons or advertising flyers, or combination thereof, will be visible to the owner of said garment each time the garment is viewed, and must be handled by said owner when said device is removed from said garment at the time of donning thereof.

In accordance with a further principal feature of my present invention a vertical cut central of said tongue extends outwardly from the central transverse cut, and a die-formed crease extends from the outer end of said vertical cut to the outer end of said tongue, whereby, when said fingers are fully engaged with the collar of a garment and said tongue overlies said collar, the pressure of a single finger on said outer crease can bend said outer portion of said tongue into said collar until said outer portion of said tongue is substantially perpendicular to the back panel of said garment and said ears engage the portion of the garment body juxtaposed to the inner face of the collar, whereby said device claspingly engages said collar and said portion of said garment confronting the inner face of said collar, thereby locking said device to said garment.

In accordance with another principal feature of my present invention a pair of transverse cuts, parallel to and located outwardly of the aforementioned transverse cuts, define a pair of pressure relief tabs, which pressure relief tabs resiliently bend and thus prevent the marking of the collar of the garment.

For a fuller understanding of the nature and objects of my present invention, reference should be had to the following detailed description, taken in connection with the accompanying drawings.

DESCRIPTION OF THE PREFERRED EMBODIMENTS

Figure 1:
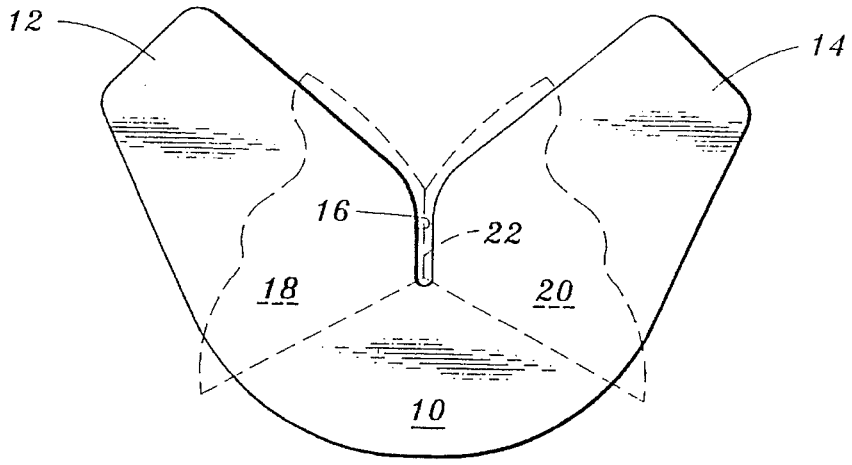
Fig. 1 (Prior Art)
FIGS. 1, 2 and 3 illustrate prior art, commercially available garment collar shaping devices.
Figure 2:
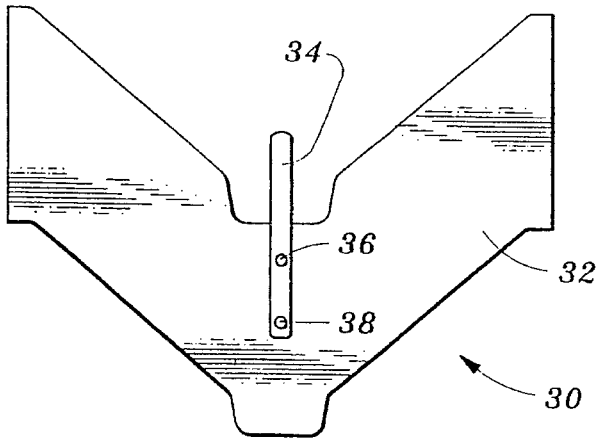
Fig. 2 (Prior Art)
Figure 3:
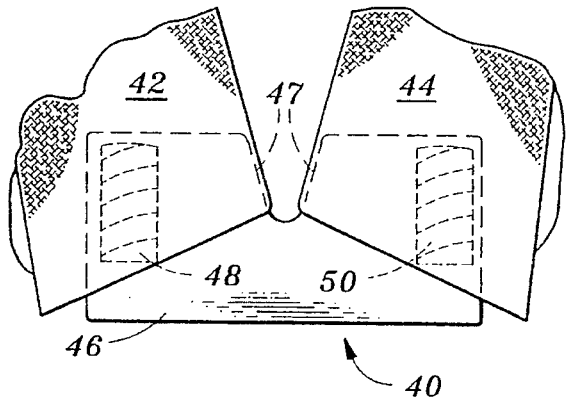
Fig. 3 (Prior Art)
Figure 4:
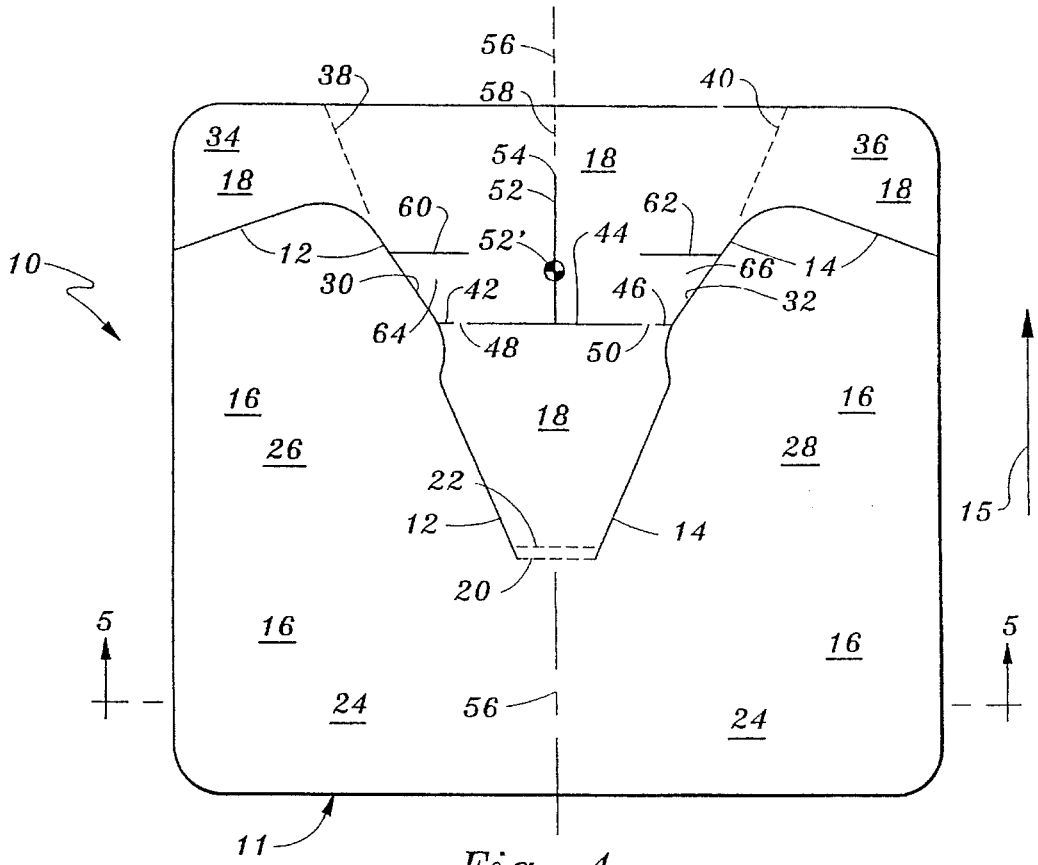
FIGS. 4 and 5 illustrate the first preferred embodiment of my invention.
Figure 5:
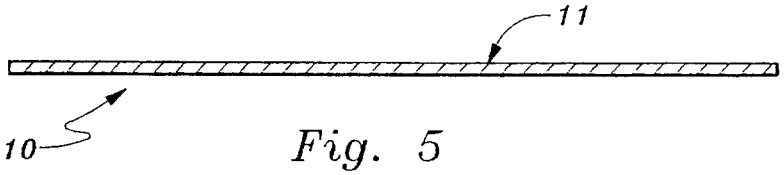

Referring now to FIG. 4, there is shown a garment collar shaping device 10 of the first preferred embodiment of my invention.

For compactness and convenience of discussion the terms "collar shaper" or "collar support" will sometimes be substituted for the term "garment collar shaping device", or the like, hereinafter.

In accordance with the first preferred embodiment of my invention collar shaper 10 (FIG. 4) consists of a single piece 11 of paperboard, or some other resilient, flexible sheet material, e.g., sheet material of the type sometimes referred to as "plastic".

The term "paperboard" is used herein in its broadest acceptation to embrace all of those sheet materials sometimes known as "cardboard", "pasteboard", "pulp board", "card stock", or "chip board" and all similar sheet materials.

By way of example, a working embodiment of collar shaper 10 of the first preferred embodiment was fabricated from recycled paperboard of the kind sometimes called "chip board" the measured thickness of which was approximately 0.022 inches. This paperboard, called "chip board", was made by BZ Converting and imprinted with the nominal thickness "0.026" (26 points) and also imprinted C1S (coated one side). It is to be understood, however, that the scope of my invention is not limited to this particular type of flexibly resilient sheet material, nor to this particular thickness dimension.

It is further noted here, for completeness of disclosure, that such recycled paperboard is generally characterized by having a particular grain orientation, i.e., by the fact that the fibers visible on the uncoated side can be seen to generally extend parallel to one dimension of the sheet of paperboard from which the individual collar shapers 10 are cut. This direction of the extension of the majority of elongated grains of the paperboard will hereinafter be called the "grain direction". The grain direction can be determined or confirmed by placing a specimen of the paperboard across a sharp straight edge and depositing a pair of weights on the opposite sides of the straight edge and equidistant therefrom.

Maximum bowing of this specimen will occur when the straight edge is directed in the grain direction. When using certain types of paperboard it may be necessary to thus inspect each sheet of paperboard from which collar shapers 10 are to be fabricated, and to mark each sheet with an arrow or line indicating grain direction, for the use of the individual operating the die cutting press.

The grain direction (arrow 15, FIG. 4) must be parallel to the center line of the device, i.e., perpendicular to the transverse cuts and to the tongue hinge.

Referring again to FIG. 4, it will be seen that collar shaper 10 is divided by two cuts 12, 14 into a body portion or body 16 and a tongue portion or tongue 18.

As also seen in FIG. 4, tongue 18 is hingedly connected to body 16 by means of a live hinge 20. Live hinge 20 is a four point crease extending from the lower end of cut 12 to the lower end of cut 14.

In the first preferred embodiment of my invention a second four point crease 22 extends from cut 12 to cut 14, parallel to crease 20 and spaced therefrom by a small distance, e.g., 0.005 inches.

As further seen in FIG. 4, body 16 of collar shaper 10 of the first embodiment consists of three principal parts, viz., spine 24 and fingers 26, 28.

In general, spine 24 is that part of collar shaper 10 lying below a horizontal line coincident with crease 20, finger 26 is that part of collar shaper 10 lying between said horizontal line and cut 12; and finger 28 is that part of collar shaper 10 lying between said horizontal line and cut 14.

As also seen in FIG. 4, cut 12 is so configured as to define a boss 30 which projects outwardly from finger 26 toward tongue 18, and cut 14 is so configured as to define a boss 32 which projects outwardly from finger 28 in the direction of tongue 18.

Referring again to FIG. 4, and especially the upper part thereof, it will be seen that tongue 18 is so configured at its upper end as to define a pair of ears 34, 36.

For clarity of definition it is assumed that ear 34 extends outwardly from dashed line 38 (FIG. 4) and that ear 36 extends outwardly from dashed line 40. It is to be understood that dashed lines 38 and 40 do not denote cuts.

For clarity of reference the portion of tongue 18 exclusive of ears 34, 36 will sometimes hereinafter be referred to as the "central portion of tongue 18".

As further seen in FIG. 4, tongue 18 is divided into an inner portion and an outer portion by three transverse cuts 42, 44, 46. Cut 42 joins with cut 12, and cut 46 joins with cut 14. Central transverse cut 44 extends the same distance on both sides of the center line of collar shaper 10.

As particularly seen in FIG. 4, the uncut portions 48, 50 of tongue 18, extending between cut 42 and cut 44 and between cut 44 and cut 46, respectively, define a pair of small live hinges by means of which the outer portion of tongue 18 is hinged to the inner portion of tongue 18. These two small live hinges 48, 50 will sometimes hereinafter be referred to as the "medial hinges", to distinguish them from tongue hinge 20.

As also seen in FIG. 4, a vertical cut 52 extends perpendicularly from central transverse cut 90 to point 54, along the center line or line of central symmetry 56 of collar shaper 10.

As also seen in FIG. 4, a crease 58 extends from point 54 to the upper edge of tongue 18, along center line 56.

As yet further seen in FIG. 4, a horizontal cut 60, parallel to transverse cut 44, extends inwardly of the outer portion of tongue 18 from cut 12, and a horizontal cut 62, parallel to central transverse cut 44, extends inwardly of the outer portion of tongue 18 from cut 14.

Thus, as seen in FIG. 4, a tab 64 is defined between cut 60 and cut 42, and a tab 66 is defined between horizontal cut 62 and cut 46.

For reasons which will be apparent hereinafter, tabs 64, 66 will sometimes hereinafter be called "relief tabs".

Figure 6:
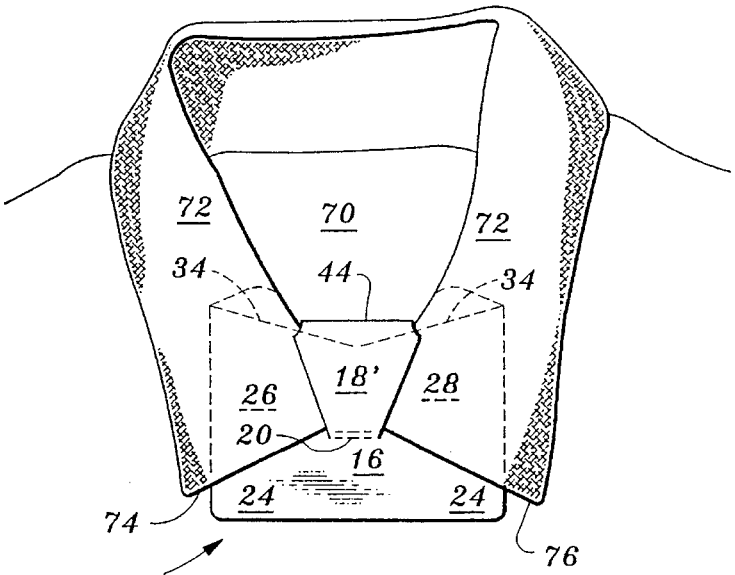
FIGS. 6 and 7 show said first preferred embodiment installed in a shirt.

Referring now to FIG. 6, there is shown a shirt 70 having a collar 72 in which is installed collar shaper 10 of the first preferred embodiment of my invention.

When collar shaper 10 is installed in shirt 70, as seen in FIG. 6, the spine 24 of body 16 generally lies below collar 72, and fingers 26, 28 of body 16 lie between the respective end portions of collar 72 and the respective front panels of the body of shirt 70.

As will be evident to those having ordinary skill in the art, comparing FIGS. 4 and 6, only the inner part 18' of tongue 18, below transverse cut 44, is shown in FIG. 6, the outer portion 18" of tongue 18 being so folded about cut 44 that it lies within the uppermost portion of shirt 70 and ears 34, 36 bear against the inner faces of the respective front panels of shirt 70.

As also seen in FIG. 6, the lower portion of tongue 18 overlies the mutually adjacent extremities of collar 72.

As will be evident to those having ordinary skill in the art, informed by the present disclosure, collar shaper 10 of the first preferred embodiment of my present invention is equally well adapted to virtually instant installation in box-folded shirts and in hanger-mounted shirts.

Figure 7:
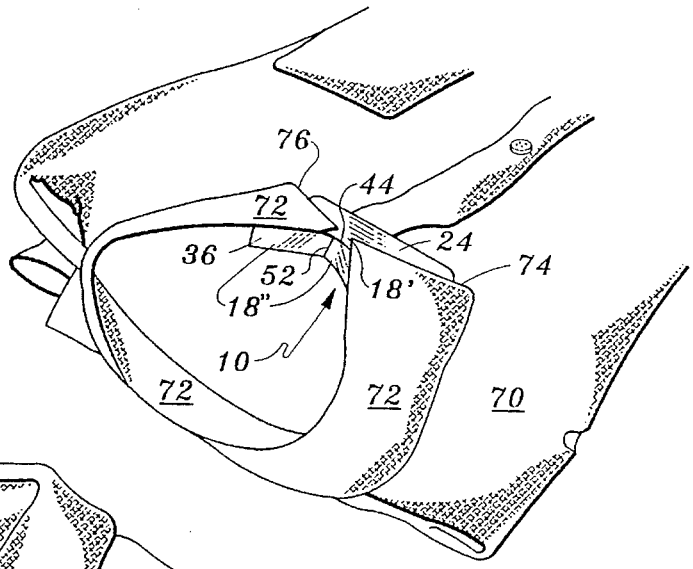

Referring now to FIG. 7, there is shown box-folded shirt 70 of FIG. 6, so oriented as to provide a view looking into the neck of shirt 70.

As seen in FIG. 7, collar shaper 10 of the first preferred embodiment of my invention is installed in shirt 70.

When collar shaper 10 is so installed, spine 24 protrudes below the outer edges 74, 76 of collar 72 and the inner part 18' of tongue 18 overlies the most closely adjacent end portions of collar 72.

As further seen in FIG. 7, tongue 18 is bent along the line of inner transverse cut 44, so that the inner portion 18' of tongue 18 is substantially perpendicular to the outer or lower portion 18' of tongue 18, and thus ear 36 (and ear 34, not shown) are erected between the back panel of shirt 70 and the respective front panels of shirt 70, behind collar 72.

As also seen in FIG. 7, the outer portion 18" of tongue 18 automatically bends along the line of vertical cut 52 when outer portion 18" is being manually bent into collar 72.

Thus, as will be understood by those having ordinary skill in the art, informed by the present disclosure, collar shaper 10 of the preferred embodiment of my present invention, and particularly upper tongue portion 18", serves not only to maintain the outer ends 74, 76 of collar 72 in optimum relationship until shirt 70 is donned, but also serves to space the front part of collar 72 from the back of shirt 70, thereby reducing wrinkling of the body of shirt 70 and avoiding the formation of two creases in collar 72, as occurs when some of the prior art devices are used.

Figure 8:
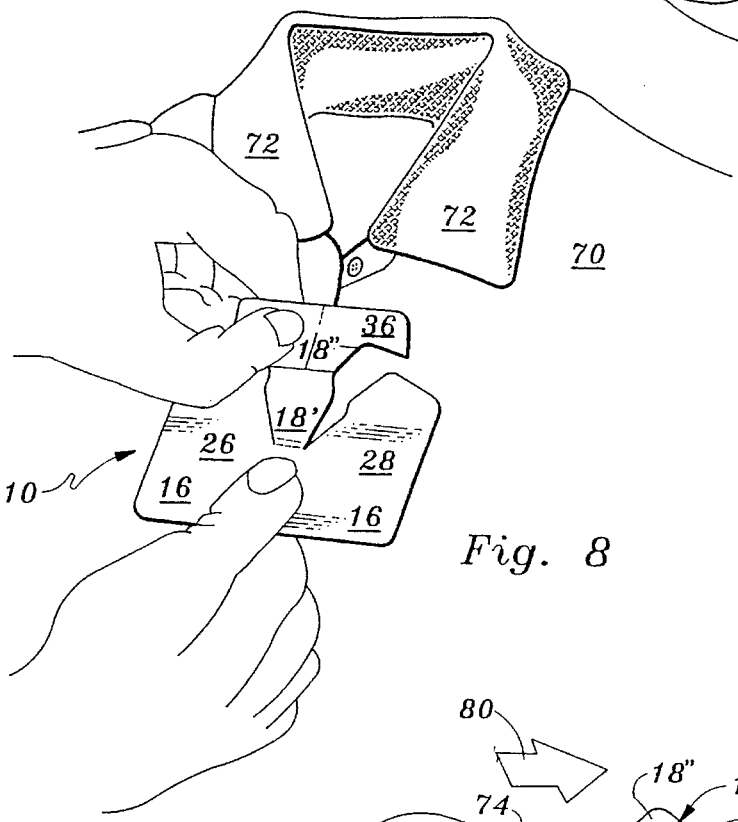
FIGS. 8 and 9 show successive stages in the installation of said first preferred embodiment in a shirt.
Figure 9:
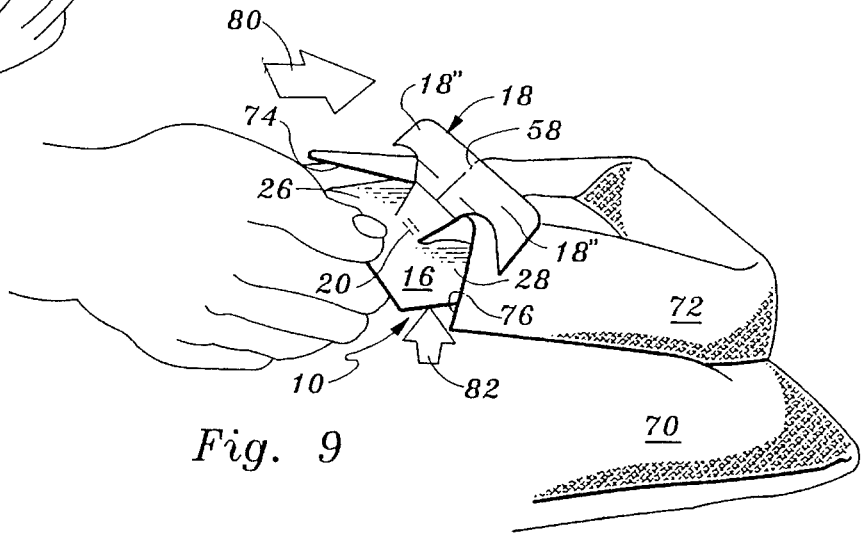

Referring now to FIGS. 8 and 9, the preferred method of installing collar shaper 10 of the first preferred embodiment of my invention in shirt 70 will be described.

Referring to FIG. 8, it will be seen that, firstly, collar shaper 10 is manually held above shirt 70 in close juxtaposition to collar 72, and then tongue 18 is manually raised from the plane of body 16 to an angle of about 30 degrees.

It is to be understood that for most easy and expeditious installation of collar shaper 10 in shirt 70 tongue 18 is to be raised no more than about 30 degrees.

Referring now to FIG. 9, it will be seen that in the next stage of installation of collar shaper 10 ears 26, 28 of collar shaper 10 are passed under the outer ends 74, 76 of collar 72 with tongue 18 overlying collar 72.

Collar shaper 72 is thus manually thrust toward collar 72 in the direction indicated by arrow 80 (FIG. 9) until hinge 20 is closely adjacent collar ends 74, 76, as shown in FIG. 6.

It is to be emphasized that, in accordance with the basic installation techniques learned by extensive experimentation with models of collar shaper 10 and its design predecessors, collar shaper 10 must be raised toward collar 72, i.e., the ends of collar 72 lifted, in the direction indicated by arrow 82 (FIG. 9) in order to most rapidly and easily fully engage collar shaper 10 with collar 72 as shown in FIG. 6.

Downward and inward pressure of a single finger on tongue 18 in the area denoted by the reference numeral 52' (FIG. 4), forcing outer tongue 18", without additional manipulation, will then result in the erection of outer tongue 18" within collar 72 as shown in FIG. 7; ears 34, 36 automatically folding to pass through collar 72 and then automatically spreading underneath collar 72 by virtue of the structure of collar shaper 10 of the first preferred embodiment of my present invention as hereinabove shown and described.

Figure 10:
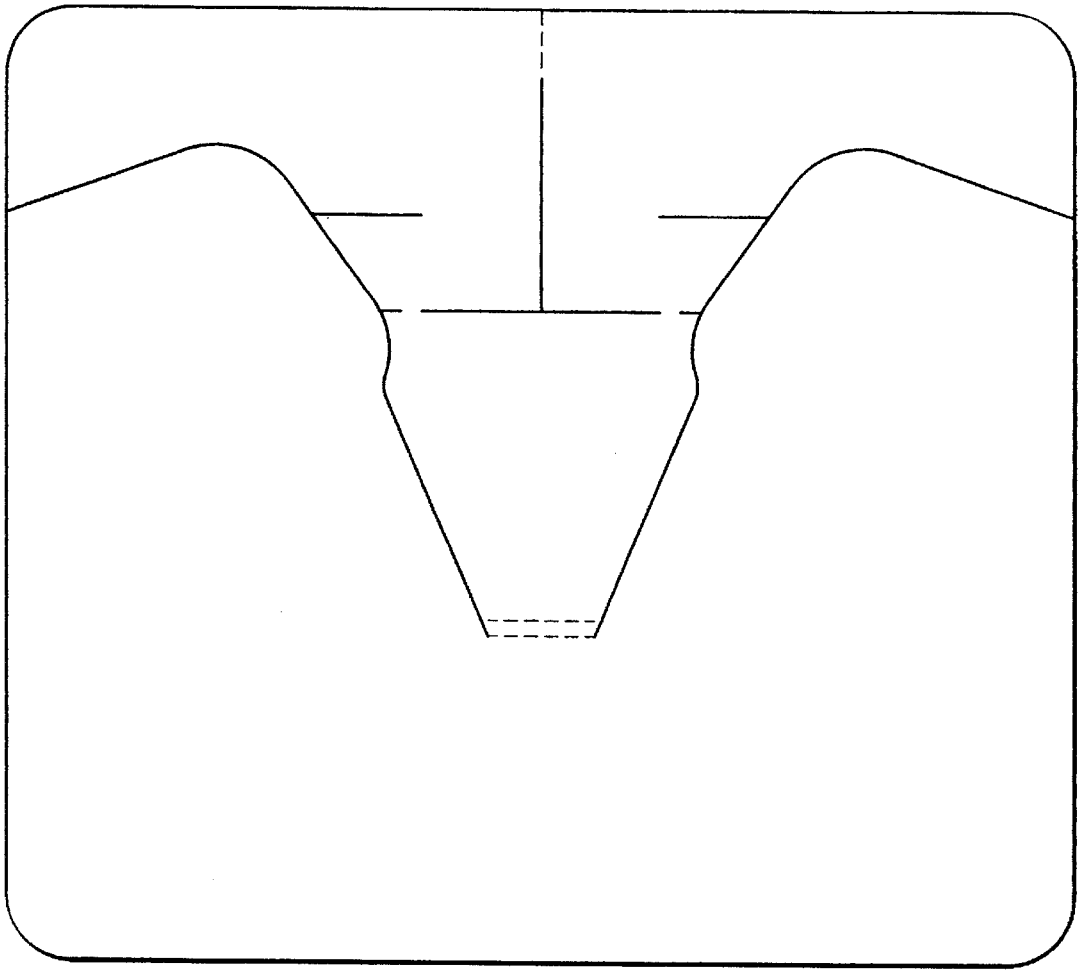
FIG. 10 is a detailed drawings of said first preferred embodiment.

Referring now to FIG. 10, there is shown the specific dimensions of collar shaper 10 of the first preferred embodiment of my invention as constructed in accordance with the best mode of carrying out the invention now known.

Figure 11:
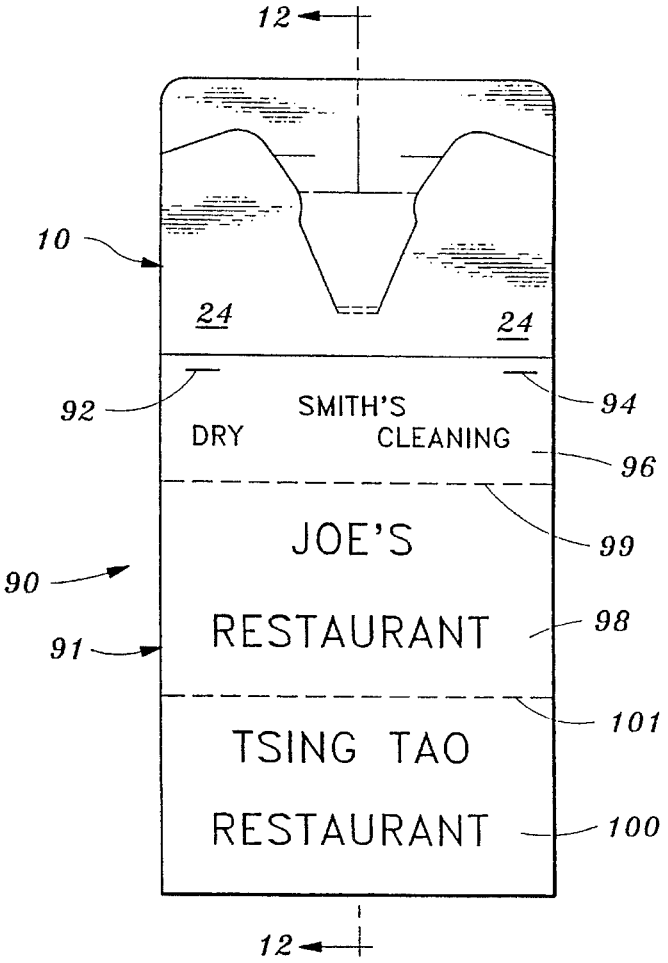
FIGS. 11 and 12 show an advertising device of my invention.
Figure 12:
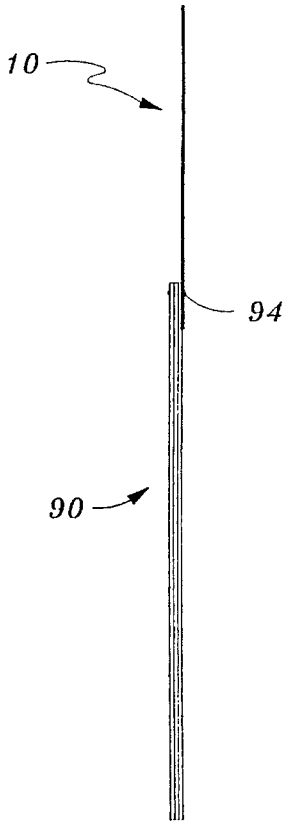

Referring now to FIGS. 11 and 12, there is shown an advertising device 90 constructed in accordance with the principles of my present invention.

As may be seen by comparison of FIGS. 11 and 12, advertising device 90 is generally comprised of a collar shaper 10 of my present invention to the spine 24 of which is affixed a pad 91 of advertising discount coupons by means, e.g., of staples 92, 94.

Advertising discount coupon pad 91 may, for example, be comprised of 24 sheets of advertising discount coupons, each sheet being four inches wide and six inches long, and the sheets being mutually joined together in the form of a pad by well known means.

As best seen in FIG. 11, the top sheet of pad 91 is comprised of an upper stub 96 which is separated from upper coupon 98 by a line 99 of perforations, and is further comprised of lower coupon 100, which is separated from upper coupon 98 by a line 101 of perforations.

In said preferred embodiment stub 96 is one inch high, and each coupon 98, 100 is 2½ inches high.

It has been discovered experimentally that as many as 48 such coupons may be affixed to a collar shaper 10 of the preferred embodiment of my invention, and upon installing collar shaper 10 in a shirt hung upon a hanger, advertising device 90 will remain in place in the collar of that shirt despite extended brisk shaking of the shirt, to an extent far greater than that believed to be undergone by a similar shirt during truck transportation.

It is to be understood that advertising devices embraced within the scope of my invention are by no means limited to the particular form shown in FIGS. 11 and 12.

Rather, the advertising device of my invention may include more or less advertising discount coupon sheets, may comprise advertising flyers, rather than advertising discount coupons, and may be affixed to collar shaper 10 by means other than staples.

Figure 13:
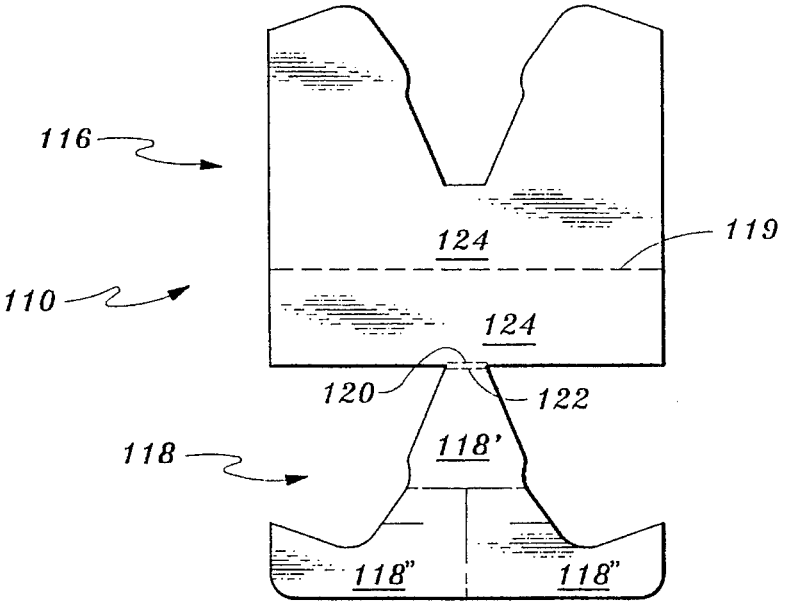
FIG. 13 shows an alternative embodiment of my invention.

Referring now to FIG. 13, there is shown a collar shaper 110 constructed in accordance with the second preferred embodiment of my invention.

As seen in FIG. 13, collar shaper 110 is cut from a single piece of paperboard of the same kind employed in fabricating collar shaper 10.

Collar shaper 110 is generally comprised of a body 116 and a tongue 118 joined along a hinge perforation 119.

The contour of body 116 is in general similar to the contour of body 16 shown in FIG. 4 and the contour of tongue 118 is generally similar to the contour of tongue 18 shown in FIG. 4.

Spine 124 of collar shaper 110 is generally of the same shape and size as spine 124 of collar shaper 10 shown in FIG. 4. However, as will be evident to those having ordinary skill in the art, informed by the present disclosure, spine 124 is duplicated on both sides of hinge perforation 119.

Similarly, tongue hinge 120 is generally substantially identical to tongue hinge 20 of collar shaper 10 of the first preferred embodiment.

Further, the horizontal and vertical cuts and the vertical perforation of tongue 110 is in generally substantially identical to the same cuts and the same perforation found in tongue 18 of collar shaper 10 of the first preferred embodiment of my invention.

The manner of installing collar shaper 110 in a shirt will be evident to those having ordinary skill in the art, informed by the present disclosure, and particularly as informed by FIGS. 6 through 9 and the text of the present specification related thereto.

It is to be noted that, when desired, outer tongue portion 18" may be bent beyond the erect position shown in FIG. 7, thus allowing more shirts to be placed in a shirt box, or to be kept on a hanger rail.

It will thus be seen that the objects set forth above, among those made apparent from the preceding description, are efficiently attained, and since certain changes may be made in the above constructions and the methods carried out thereby without departing from the scope of our present invention, it is intended that all matter contained in the above description or shown in the accompanying drawings shall be interpreted as illustrative only, and not in a limiting sense.

It is also to be understood that the following claims are intended to cover all of the generic and specific features of our invention herein described, arid all statements of the scope of our invention which, as a matter of language, might be said to fall therebetween.

What is claimed is:

1. A collar shaper, comprising:

a body member formed from resiliently flexible sheet material and including a spine portion and two finger portions projecting outwardly from said spine portion;

a tongue member integral with said body member and hingedly joined to said spine portion by inner hinge means, said tongue member being comprised of an inner portion and an outer portion; and first and second outer hinge means joining said inner tongue portion and said outer tongue portion;

said first and second outer hinge means lying on a line which passes through both of said finger portions; and a first cut extending from said first outer hinge means to said second outer hinge means, and a second cut joined to said first cut and extending therefrom in a direction away from said inner hinge means.

2. A collar shaper as claimed in claim 1, further comprising third hinge means extending from the end of said second cut remote from said first cut toward the periphery of said body member.

3. A collar shaper as claimed in claim 2, further comprising first and second substantially collinear cuts lying parallel to said first cut and respectively directed inwardly from the opposite edges of said tongue member.

* * * * *